US007422281B2

(12) United States Patent
Miller

(10) Patent No.: US 7,422,281 B2
(45) Date of Patent: Sep. 9, 2008

(54) KNIT FORM-FIT SLIPCOVER

(75) Inventor: Brenda K. Miller, Jersey Shore, PA (US)

(73) Assignee: Sure Fit Inc., Allentown, PA (US)

( * ) Notice: Subject to any disclaimer, the term of this patent is extended or adjusted under 35 U.S.C. 154(b) by 0 days.

(21) Appl. No.: 11/285,916

(22) Filed: Nov. 23, 2005

(65) Prior Publication Data

US 2007/0114823 A1 May 24, 2007

(51) Int. Cl.
*A47C 31/11* (2006.01)

(52) U.S. Cl. ..... 297/224; 297/225; 297/228; 297/228.1; 297/229

(58) Field of Classification Search ..... 297/224, 297/225, 228, 229, 228.1
See application file for complete search history.

(56) References Cited

U.S. PATENT DOCUMENTS 1,825,909 A * 10/1931 Levi ..... 297/224
1,942,111 A * 1/1934 Levi ..... 297/224
2,083,236 A * 6/1937 Levi ..... 297/229
2,086,640 A * 7/1937 Reynolds ..... 297/229 X
2,098,684 A * 11/1937 Fry ..... 297/224
2,100,868 A * 11/1937 Oppenheimer ..... 297/224
2,123,667 A * 7/1938 Trubitz ..... 297/229
2,183,828 A * 12/1939 Trubitz ..... 297/224
2,350,359 A * 6/1944 Krasnov et al. ..... 297/224 X
2,839,127 A * 6/1958 Schutte ..... 297/224
2,848,039 A * 8/1958 Lenz ..... 297/224
2,877,832 A * 3/1959 Reavis ..... 297/228
2,884,993 A * 5/1959 Schutte ..... 297/229 X
2,921,625 A * 1/1960 Krasnov et al. ..... 297/224
3,117,817 A * 1/1964 Mednick ..... 297/224
3,311,408 A * 3/1967 Sarvas ..... 297/224 X
3,589,770 A * 6/1971 Kelley ..... 297/225 X
3,614,156 A * 10/1971 Sarvas ..... 297/224
4,694,511 A * 9/1987 Estes et al. ..... 297/225 X
5,549,355 A * 8/1996 Illulian ..... 297/224
5,626,388 A * 5/1997 Haltner ..... 297/224 X
5,664,831 A * 9/1997 White et al. ..... 297/225
5,733,002 A * 3/1998 Riley et al. ..... 297/224
6,116,685 A * 9/2000 White et al. ..... 297/225 X
6,398,301 B1 * 6/2002 Illulian ..... 297/228
6,659,550 B2 * 12/2003 Hackett ..... 297/228
6,736,453 B2 5/2004 Chambers et al.
6,796,609 B2 9/2004 Illulian
6,827,398 B2 12/2004 Nazginov
2004/0155499 A1 8/2004 Chambers et al.

FOREIGN PATENT DOCUMENTS

FR 2690322 A1 * 10/1993 ..... 297/225

OTHER PUBLICATIONS

Stretch and Cover Brochure.

* cited by examiner

*Primary Examiner*—Rodney B. White
(74) *Attorney, Agent, or Firm*—Darby & Darby P.C.

(57) ABSTRACT

A slipcover for a piece of furniture having a base, a back, and a seat portion, wherein the slipcover fabric has a stretch in length which behaves dynamically with respect to a stretch in width, with the minimum stretch in fabric width being 60%, the minimum stretch in fabric length being 40%.

21 Claims, 15 Drawing Sheets

KNIT FORM-FIT SLIPCOVER

FIELD OF THE INVENTION

The present invention relates to a slipcover for a piece of seating-type furniture, such as a chair, loveseat, or sofa, and in particular to a knit slipcover that marries with a separate knit seat cover, which is designed to fit cushions of various dimensional ranges.

BACKGROUND OF THE INVENTION

Slipcovers are widely used by consumers as an inexpensive alternative to re-upholstering a piece of seating-type furniture. Originally, slipcovers were custom tailored by a professional having the proper tools and training to precisely fit a particular piece of furniture. Custom tailored slipcovers, however, are typically as expensive as the cost of re-upholstering the piece of furniture.

Prefabricated slipcovers that can fit a variety of furniture items of typical dimensions and which can be more readily applied by the consumer have been designed. Though these slipcovers tend to be less expensive to produce than custom-tailored ones, they can be difficult to design to accommodate various styles and shapes of furniture, and often result in an unsatisfactory appearance due to improper fit.

BRIEF SUMMARY OF THE INVENTION

It is an object of the invention to provide a two-piece slipcover that accommodates various styles and shapes of furniture to provide a form fit with ease of application and low maintenance for the customer.

A slipcover for a piece of furniture having a base, a back, and a seat portion, wherein the slipcover fabric has a stretch in length which behaves dynamically with respect to a stretch in width, with the minimum stretch in fabric width being 60%, the minimum stretch in fabric length being 40%.

BRIEF DESCRIPTION OF THE DRAWINGS

The foregoing and other features of the present invention will be more readily apparent from the following detailed description and drawings of illustrative embodiments of the invention, wherein like reference numerals delineate similar elements throughout the several views. In the drawings.

DETAILED DESCRIPTION OF CERTAIN EMBODIMENTS OF THE INVENTION

Figure 1:
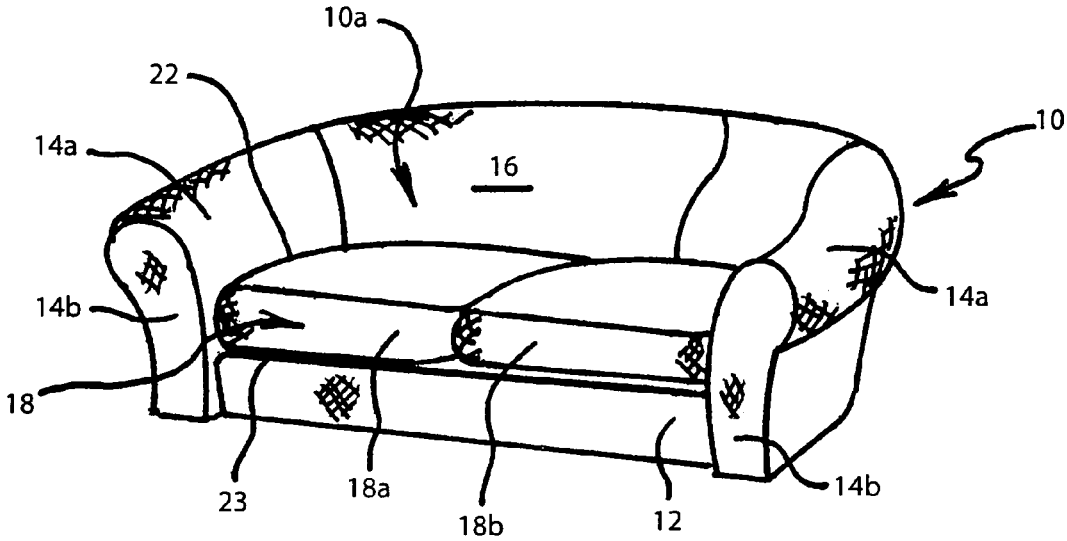
FIGURE 1 PRIOR ART
FIG. 1 is a perspective view of a front side of a conventional item of seating-type furniture, in the form of a sofa.
Figure 2:
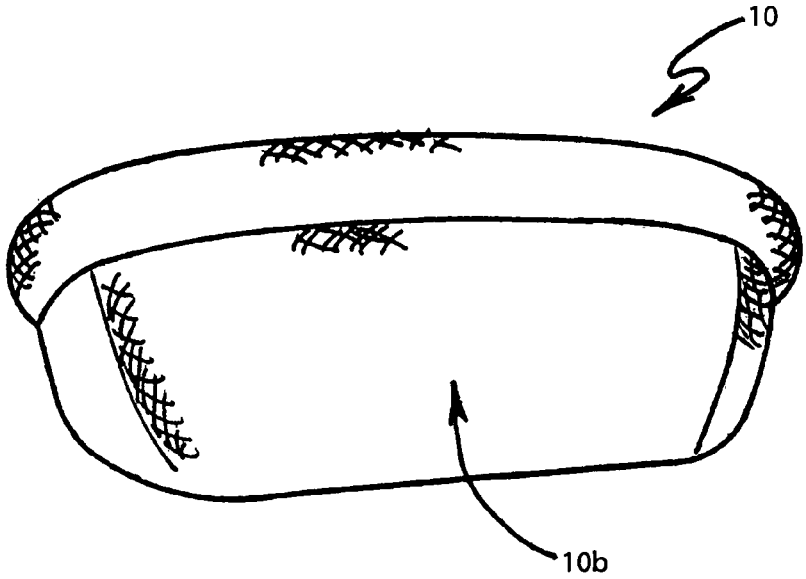
FIGURE 2 PRIOR ART
FIG. 2 is a view of the rear side of the item of seating-type furniture illustrated in FIG. 1.

FIGS. 1 and 2 illustrate a typical item of seating-type furniture 10, which for purposes of this example, is a seat in the form of a sofa. It will be noted, however, that slipcovers according to the present invention may be used in combination with any of a variety of types of seating-type furniture having a base, a back, and at least one seat cushion (in the shape of a box (as shown) or a t, for example), e.g., club chairs, sofabeds, and the like, though a seat cushion is not necessarily required. FIG. 1 illustrates the front side 10*a* (i.e., the seated side) of the sofa 10, while FIG. 2 illustrates the rear side 10*b* of the sofa. The sofa includes a seat base 12, which is typically somewhat rigid so that it can support the rest of the furniture body and things which may be positioned thereon, such as a person (not shown). The base 12 can be of a variety of shapes, and may include supplemental legs (not shown) or the like.

The sofa 10 preferably includes first and second arms 14 (which include arm sides 14*a* and arm fronts 14*b*), which extend upwardly from opposite ends of the base 12, and are connected to each other by way of a sofa back 16. The back 16 is illustrated as being relatively smooth and continuous, though it is noted that any of a variety of shaped sofas could also be used in combination with a slipcover according to the present invention. For example, the back 16 of the sofa 10 to be covered can be of the conventional camel back shape, or the like.

A cushioned region 18 (i.e., individual cushions 18*a*, 18*b*), which is separable from the seat base 12, extends substantially horizontally across the sofa base 12, to provide a sitting surface for a user of the sofa 10. In the figure, the cushioned region 18 includes first and second individual seat cushions 18*a*, 18*b*. It is noted, however, that items of furniture usable in combination with slipcovers of the present invention can include a single bench-style cushion or a plurality of cushions.

The present invention is realized through stretch properties of the slipcover fabric having a stretch in length and a stretch in width which behave dynamically with respect to each other. The minimum stretch in fabric width is 60%, and the minimum stretch in fabric length is 40%. The slipcover is form-fit to the furniture when the stretch in fabric width is 60% is reduced by 10%, and the stretch in fabric length is 40% is reduced by 25%. The slipcover fabric has a minimum of 5% spandex or other suitable elastic fiber. The testing method used to measure the stretch properties of the slipcover fabric is outlined in the ASTM reference manual as ASTM D2594.

According to a first embodiment of the present invention, the fitted slipcover base is specifically designed to fit a variety of furniture with T-shaped cushions. Specific attributes of T-cushion furniture addressed with this design are a deeper seat depth, a shorter side width, a T-shaped base, and shorter arm height. This slipcover is of two-piece construction and has a separate fitted T-shaped cushion cover that is applied over the seat cushion(s) located on the furniture.

More specifically, the slipcover has a fitted T-shaped base that is designed to fit a range of T-cushion furniture bases to hug the face of the arm(s), the T-area of the seat, and the perimeter or base of the furniture where a band with enclosed free-floating elastic holds the slipcover to the underside of the furniture. The arm front in a relaxed state fits narrow arm widths and dynamically stretches to fit wider arm widths; the fabric will also relax or stretch to accommodate a range of arm heights. An advantage of the T-shaped cushion cover of the present invention is the ability to cover any number of cushions present on the furniture with one seat cover that form fits to the shape of the cushion(s) via the dynamic stretch of the fabric.

Figure 3A:
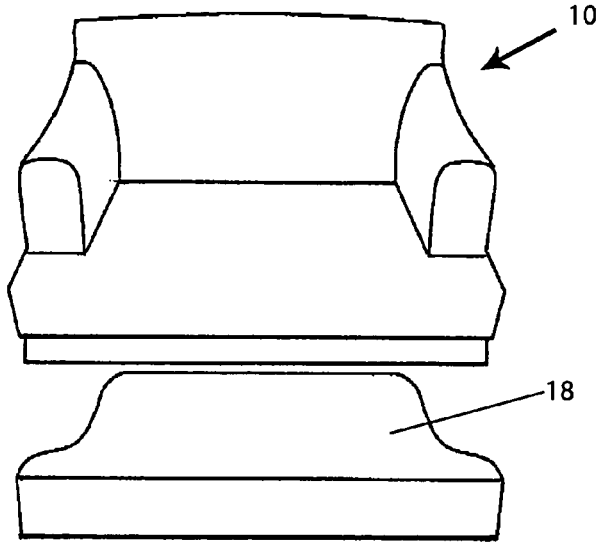
FIGS. 3A-3F are perspective views of a slipcover according to a first embodiment of the present invention being applied to the seating-type furniture illustrated in FIG. 1.
Figure 3B:
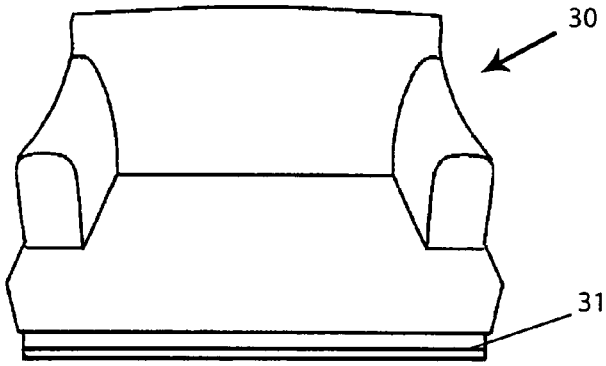
Figure 3C:
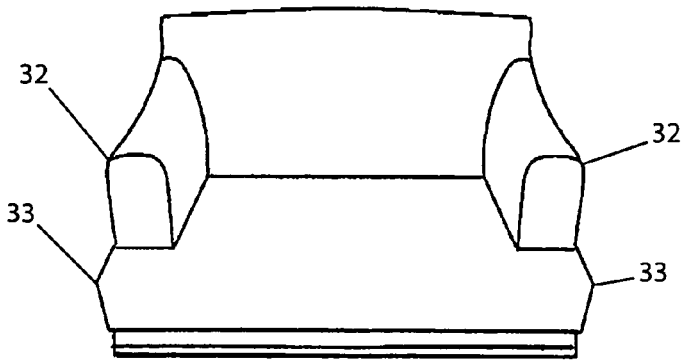
Figure 3D:
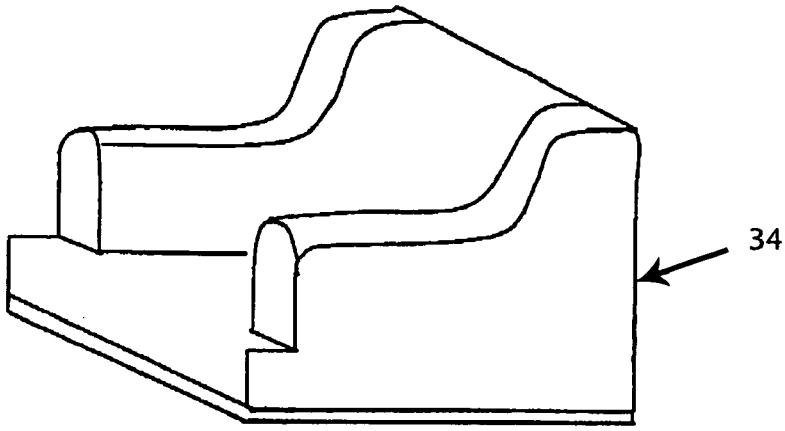
Figure 3E:
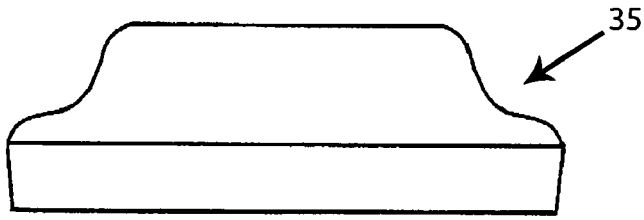
Figure 3F:
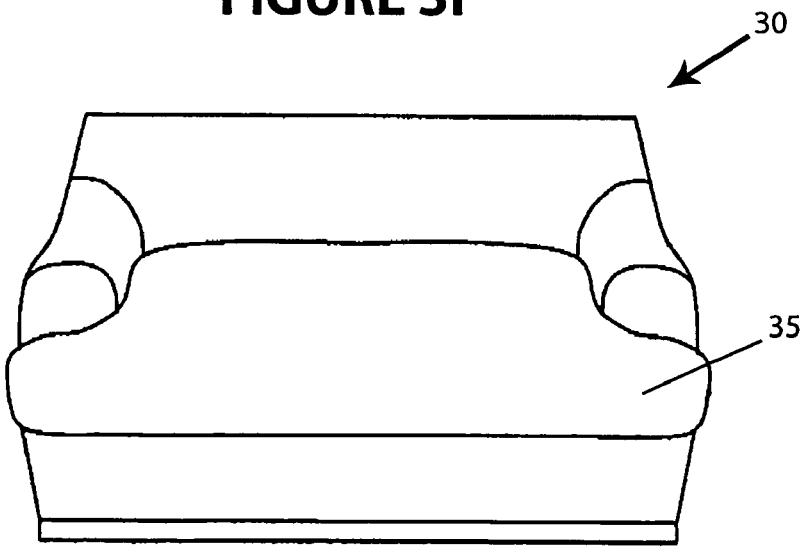
Figure 4:
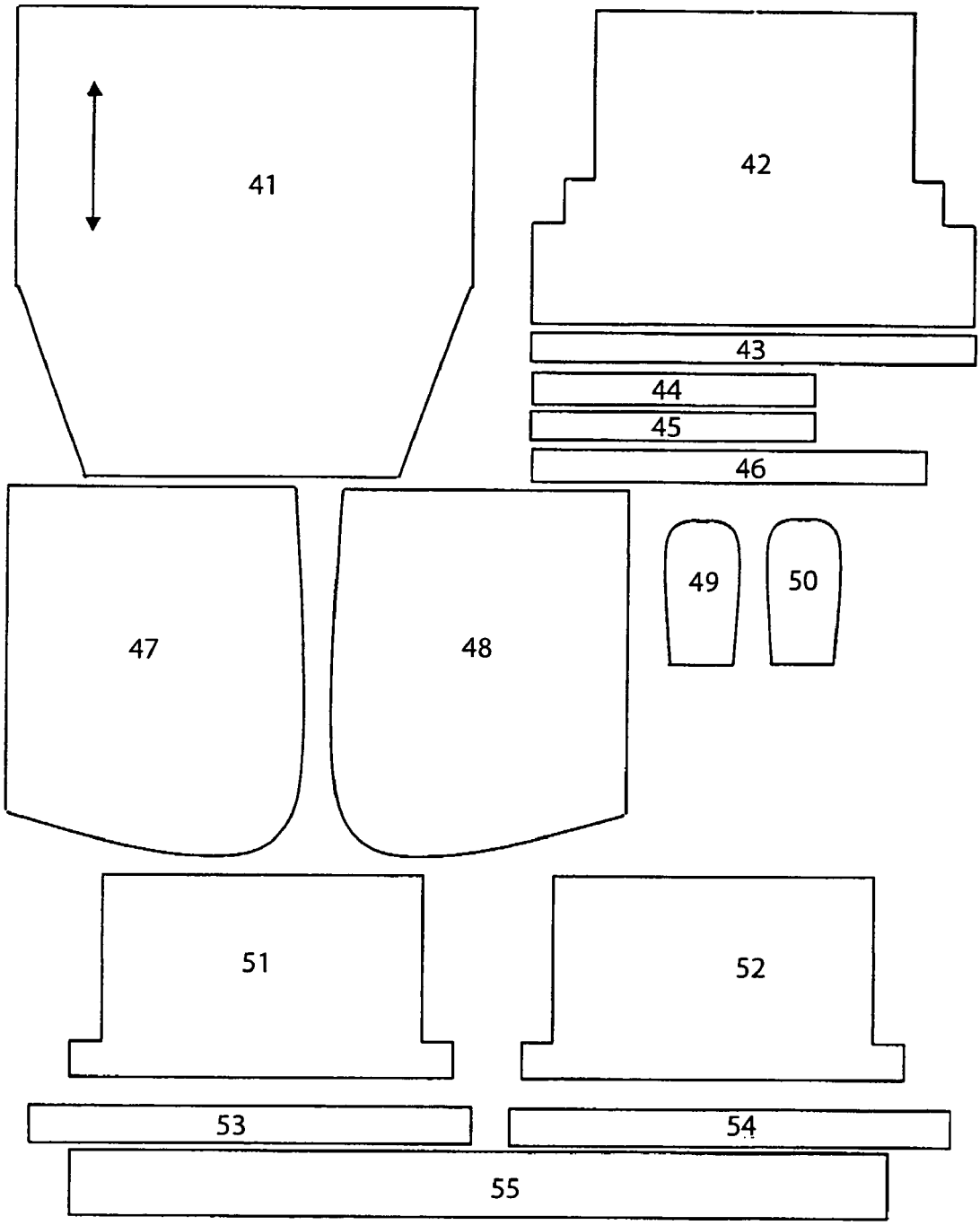
FIG. 4 is a plan view of the pattern components of the slipcover of FIGS. 3A-3F.

The slipcover according to the first embodiment of the present invention is shown generally at 30 in FIGS. 3A-3F, 4, and 5A-5O, with FIGS. 3A-3F illustrating the slipcover 30 being applied to the sofa 10 depicted in FIGS. 1 and 2, FIG. 4 illustrating pattern components of the slipcover 30 of FIGS. 3A-3F, and FIGS. 5A-5O illustrating a sewing sequence for assembling the pattern components of FIG. 4 to manufacture the slipcover 30 of FIGS. 3A-3F.

FIGS. 3A-3F illustrate the slipcover 30 being applied to the sofa 10 illustrated in FIGS. 1 and 2. As shown in FIG. 3A, the cushion(s) 18 are removed from the sofa (or alternatively, a loveseat or chair).

As shown in FIG. 3B, the slipcover 30 is applied over the top of the sofa 10, and then an elastic band 31 is placed at the base of the sofa 10. As shown in FIG. 3C, the arms of the slipcover 30 are set at points represented by reference numeral 32. The T-shape of the seat base is then lined up over the T-shape of the sofa 10 at points represented by reference numeral 33. The back seams 34 of the slipcover are then lined up at the back corners of the sofa 10, as shown in FIG. 3D.

As shown in FIG. 3E, the T-shaped seat cushion is covered with a separate cushion cover 35. Then as shown in FIG. 3F, the covered T-shaped seat cushion is set onto the base 12 of the sofa 10. Alternatively, there could be multiple seat cushions in place of the single seat cushion.

Figure 5A:
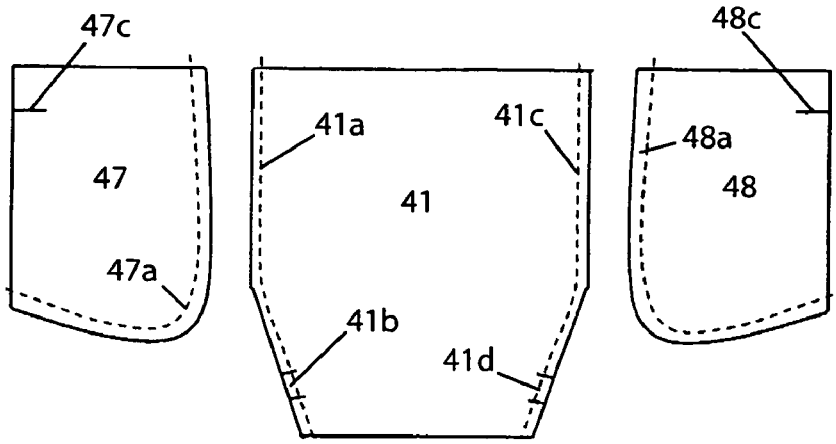
FIGS. 5A-5O are plan views illustrating a sewing sequence for assembling the pattern components of FIG. 4 to manufacture the slipcover of FIGS. 3A-3F.

FIG. 4 is a plan view of the pattern components of the slipcover 30 of the first embodiment of the present invention. FIGS. 5A-5O are plan views illustrating a sewing sequence for assembling the pattern components of FIG. 4 to manufacture the slipcover of FIGS. 3A-3F.

Referring to FIG. 4, the pattern components include a back 41, seat platform 42, a front band, 43, two side bands, 44, 45, a back band 46, two arm sides 47, 48, two arm fronts 49, 50, two separate seat covers 51, 52, two separate seat zipper bands 53, 54, and a separate seat band 55. More specifically, the back 41 is similar to an upside-down gumdrop in shape with straight side edges and a flat, lower portion. The seat platform 42 is shaped similarly to a top-hat, but with an extra step. The front band 43, two side bands 44, 45 and back band 46 are each rectangular in shape, with the front band 43 and back band 46 being longer than the side bands 44, 45. Each of the two arm sides 47, 48 is essentially rectangular in shape on two sides and bowed in shape on the opposing two sides. The two arm fronts 49, 50 are gumdrop-shaped. The two separate seat covers 51, 52 are shaped like top-hats. The two separate seat zipper bands 53, 54 and the separate seat band 55 are each rectangular in shape, with the separate seat band 55 being wider and shorter than the seat zipper bands. It is understood that while specific shapes of the pattern components have been described, it is understood that modifications to the shapes and/or sizes of these pattern components may be made provided the components are still suitable for their intended purpose.

The process for assembling the pattern components of FIG. 4 to manufacture the slipcover 30 of the first embodiment will now be described with reference to FIGS. 5A-5O.

Referring to FIG. 5A, the arm sides 47, 48 are sewn to the back 41. More specifically, one side of the arm sides 47 is sewn to one side of the back 41 along seams 41*a*, 47*a* and pleated back at notch 41*b*. Similarly, one side of the other arm side 48 is sewn to the other side of the back 41 along seams 41*c*, 48*a* and pleated back at notch 41*d*.

Figure 5B:
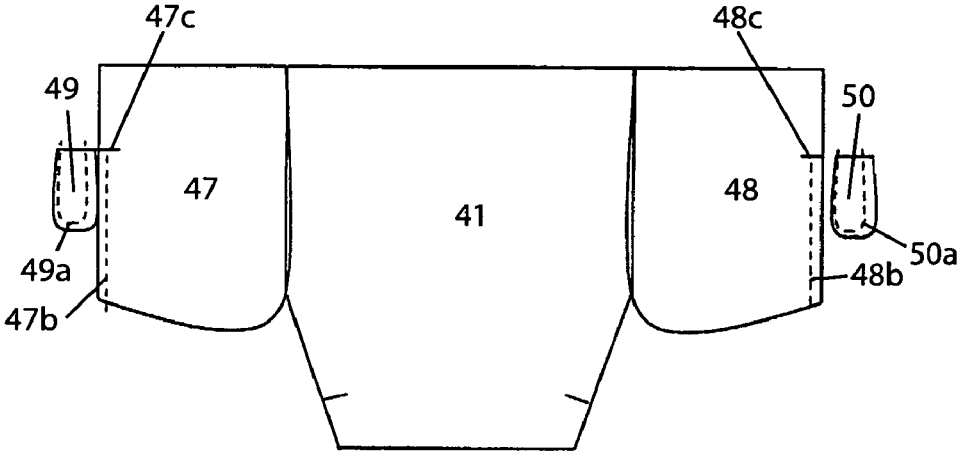

As shown in FIG. 5B, the arm fronts 49, 50 are then sewn to the respective arm sides 47, 48. More specifically, the arm front 49 is sewn to the arm side 47 along seams 49*a*, 47*b* from notch 47*c* to the end of the arm side 47. Similarly, but in the mirror image, the arm front 50 is sewn to the arm side 48 along seams 50*a*, 48*b* from notch 48*c* to the end of the arm side 48.

Figure 5C:
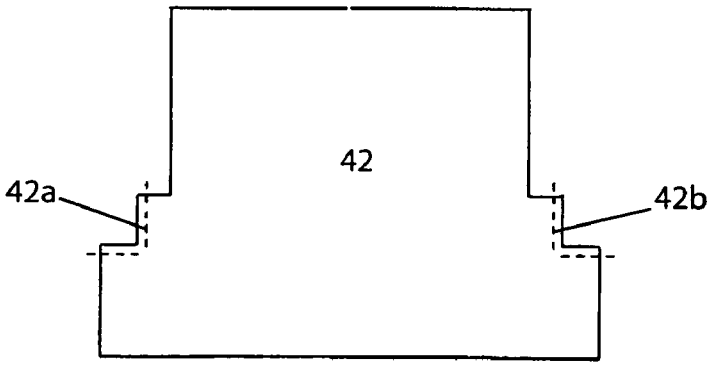
Figure 5D:
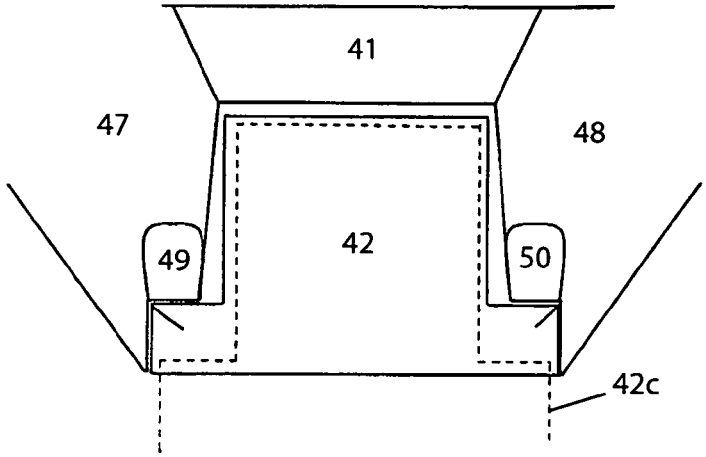

As shown in FIG. 5C, seams at corners of the seat platform 42 are joined to create a T-shape. More specifically, the seam 42*a* is joined at the corner, and the seam 42*b* is joined at another corner. As shown in FIG. 5D, the now T-shaped seat platform 42 is then joined to the arm sides 49, 50, arm fronts 47, 48, and the back 41 along seam 42*c*.

Figure 5E:
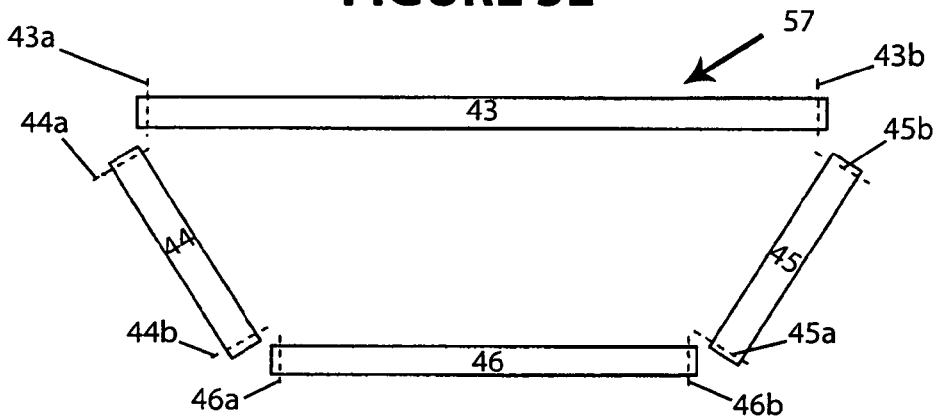

As shown in FIG. 5E, the back band 46, side bands 44, 45, and front band 43 are sewn together to form a complete band 57. More specifically, the front band 43 and the side band 44 are sewn along seams 43*a*, 44*a*, the side band 44 and the back band 46 are sewn along seams 44*b*, 46*a*, the back band 46 and the side band 45 are sewn along seams 46*b*, 45*a*, and the side band 45 and the front band 43 are sewn along seams 45*b*, 43*b*.

Figure 5F:
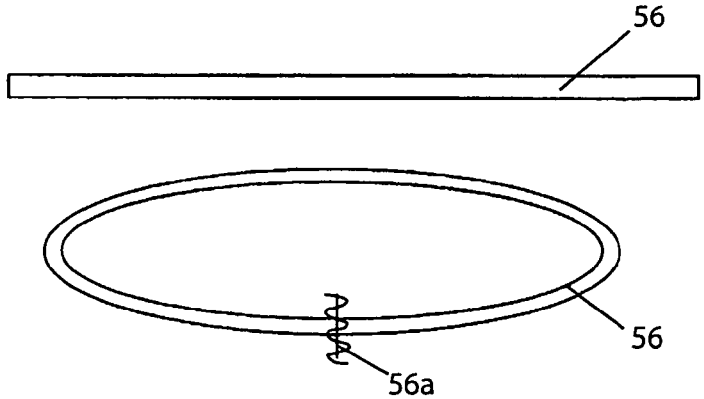
Figure 5G:
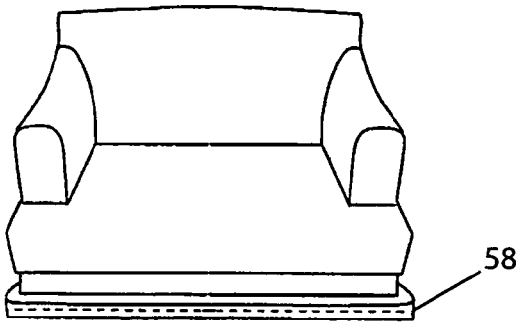
Figure 5H:
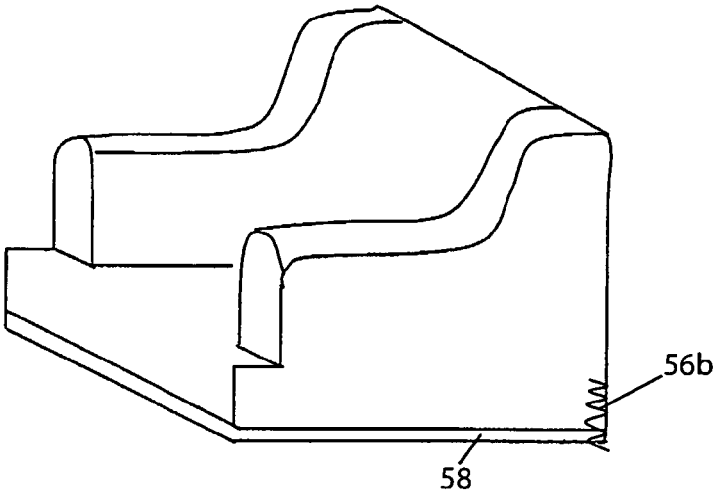

As shown in FIG. 5F, elastic 56 is cut to be half of the length of the complete band 57. (The elastic properties are defined as preshrunk and able to stretch to a minimum of 150%.) Then the ends of the elastic 56 are overlapped and bar-tacked at 56*a*. As shown in FIG. 5G, the elastic 56 is placed along the inner side of the band 57 and the combined elastic/band 58 is sewn to the bottom perimeter of the slipcover. As shown in FIG. 5H, the combined elastic/band 58 is then bar-tacked at 56*b* at the back side seam.

Figure 5I:
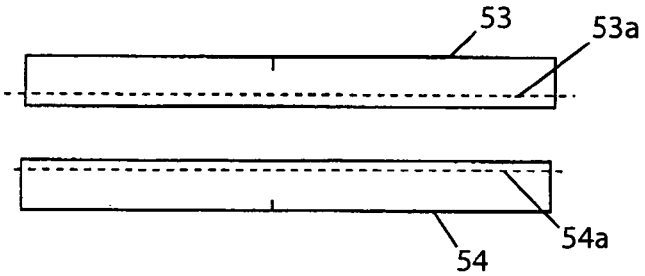
Figure 5J:
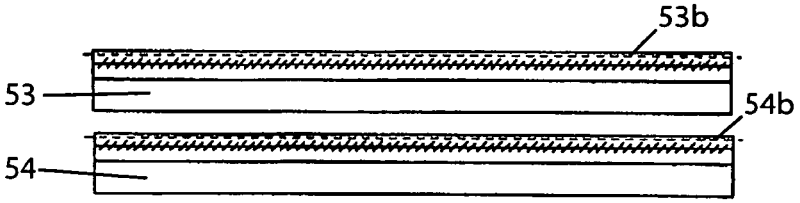
Figure 5K:
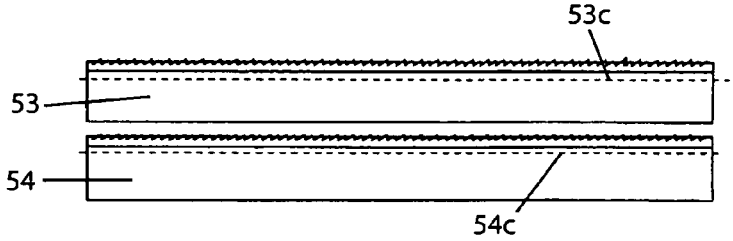
Figure 5L:
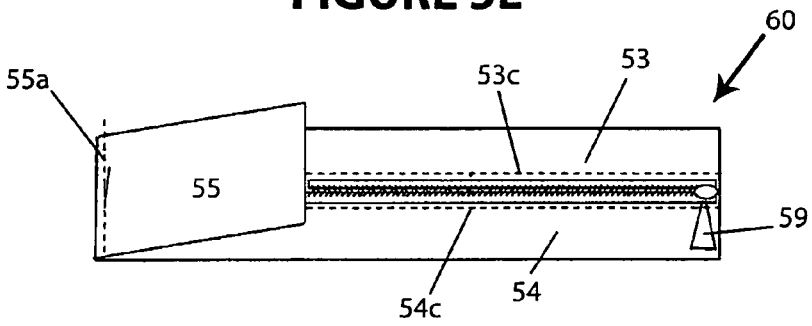
Figure 5M:
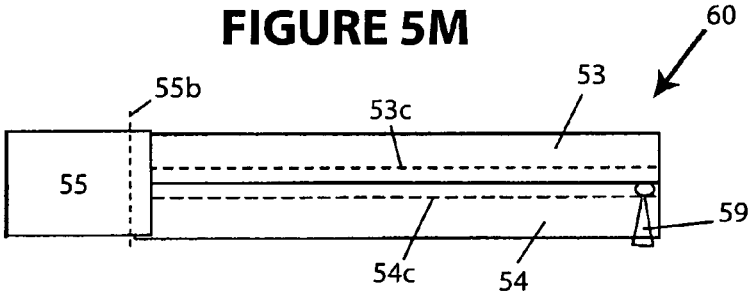
Figure 5N:
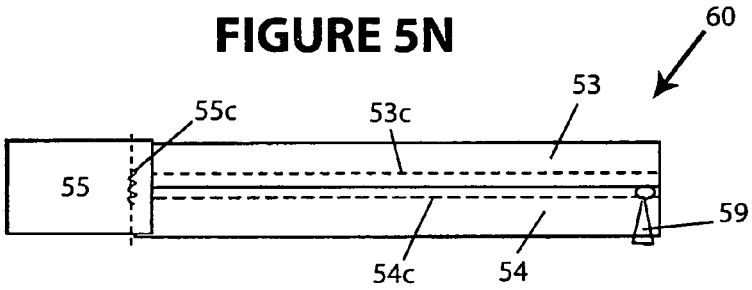
Figure 5O:
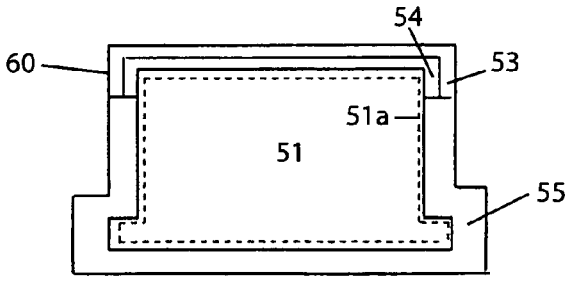

FIG. 5I shows that each of the separate zipper bands 53, 54 is edged. That is, separate zipper band 53 is edged at 53*a*, and separate zipper band 54 is edged at 54*a*. As shown in FIG. 5J, respective zipper halves 53*b*, 54*b* are then sewn to respective separate zipper bands 53, 54, and then as shown in FIG. 5K, each of the zipper halves 53*b*, 54*b* is top-stitched along lines 53*c*, 54*c*, respectively. FIG. 5L shows the zipper halves 53, 54 joined together with the addition of a zipper pull 59, this combination hereafter referred to as the zipper 60. Also, the separate seat band 55 is sewn to the zipper 60 along seam 55*a*. The separate seat band 55 is then flipped over toward the left to be flat with the zipper 60, and then a ¼" topstitch seam 55*b* is added. Finally, as shown in FIG. 5N, the separate seat band 55 is bar-tacked at 55*c* to the zipper 60 to reinforce this stress area. Similarly, the opposite end of the separate seat band 55 is sewn to the opposite end of the zipper band 54, topstitched, and bar-tacked.

As shown in FIG. 5O, the seat cushion cover is assembled. That is, the zipper 60 and the separate seat band 55 are sewn around the separate seat cover 51 at 51*a* on one side and the separate seat cover 52 (not shown) on the other side.

As discussed above, a significant feature of the slipcover of the first embodiment of the present invention is the ability of the slipcover to accommodate various dimensional ranges of furniture with T-shaped cushions. In this first embodiment this feature is accomplished through the specific stretch properties of the slipcover fabric and the design of the pattern. The slipcover therefore accommodates varied dimensional ranges of T-shaped cushion furniture, yet still provides a good fit.

According to a second embodiment of the present invention, the fitted slipcover base is specifically designed to fit a variety of furniture with box-shaped cushions. Specific attributes of box cushion furniture that are addressed within this design are two prominent seat depths, two prominent back heights, and varying arm heights and widths; all physical attributes of box cushion furniture sizing in comparison to T-shaped cushion furniture dimensions. Furthermore, the object is achieved with the design of a fitted box shaped cushion cover with zipper closure that is applied over the seat cushion(s) located on the furniture.

More specifically, the fitted slipcover has a base that is designed to fit a range of box cushion furniture bases allowing the slipcover to stretch over the largest perimeter of the furniture and then relax to the shape of the furniture with minimal tucking at the inside of the arm/back intersection. A fabric covered band with enclosed free-floating elastic holds the slipcover to the under side of the furniture. The arm front in a relaxed state fits narrow arm widths and dynamically stretches to fit wider arm widths. The fabric will also relax or stretch to accommodate a range of arm heights. The box shaped cushion cover can cover any number of cushions present on the furniture with one seat cover that form fits to the seat depth and width of the cushions via the dynamic stretch of the fabric.

Figure 6A:
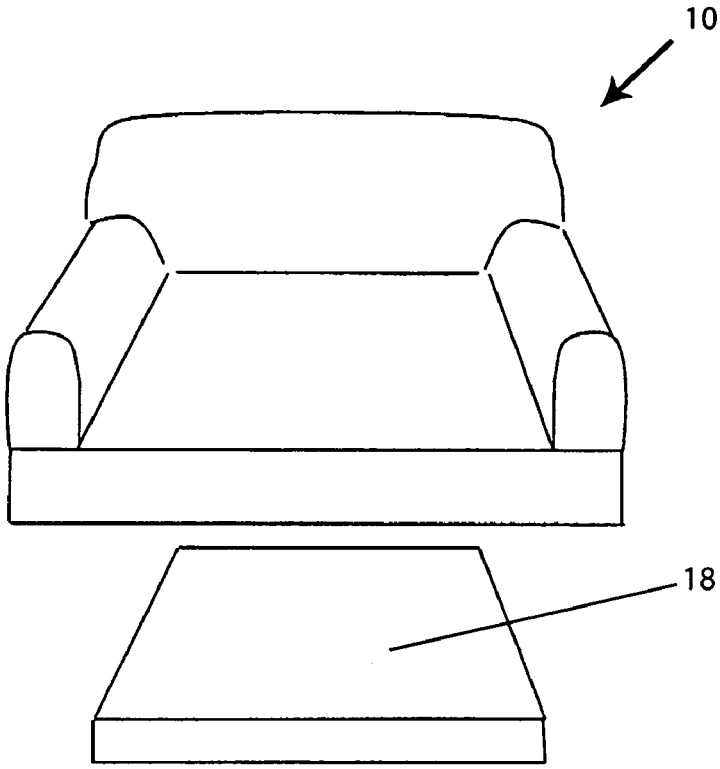
FIGS. 6A-6E are perspective views of a slipcover according to a second embodiment of the present invention being applied to the seating-type furniture illustrated in FIG. 1.
Figure 6B:
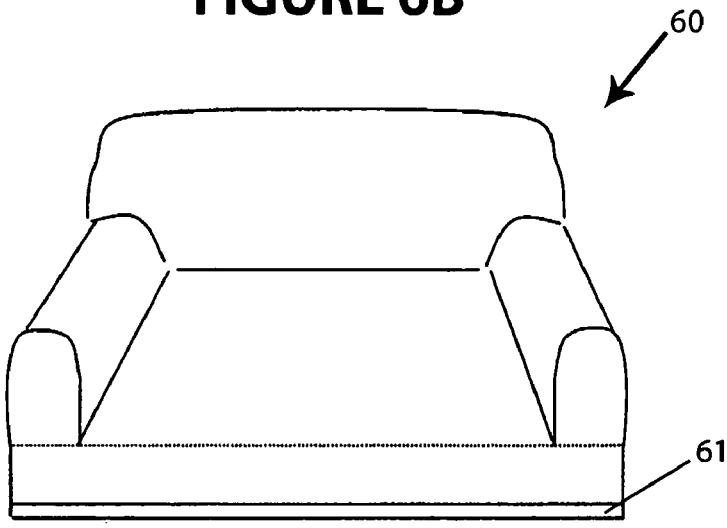
Figure 6C:
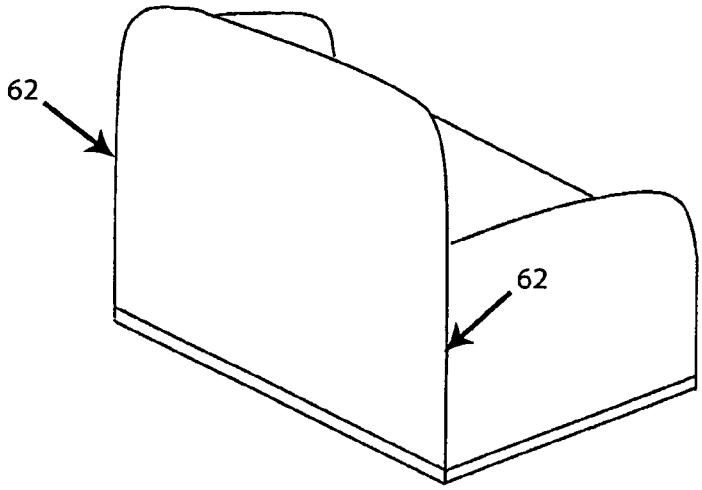
Figure 6D:
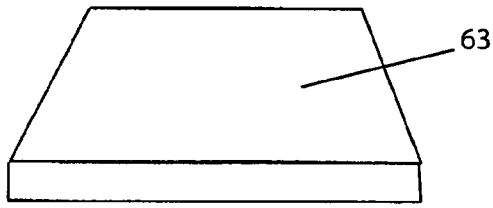
Figure 6E:
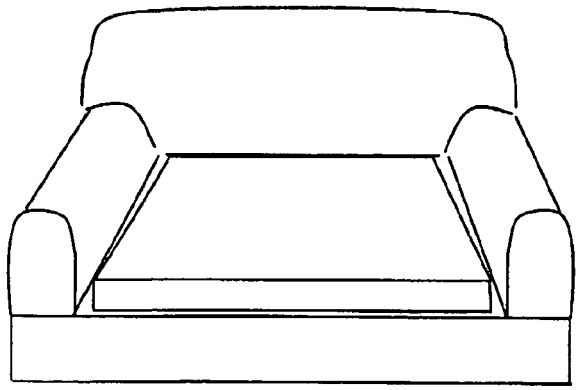
Figure 7:
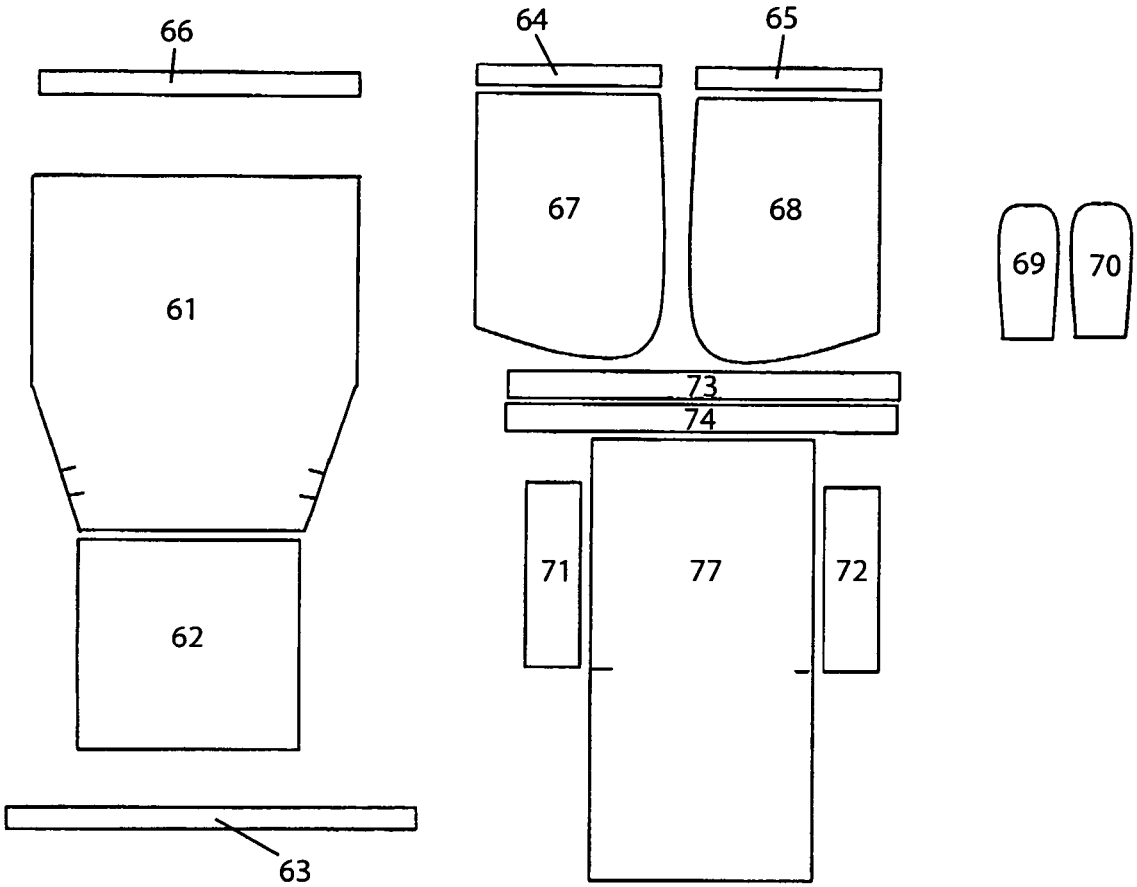
FIG. 7 is a plan view of the pattern components of the slipcover of FIGS. 6A-6E.

The slipcover according to the second embodiment of the present invention is shown generally at 60 in FIGS. 6A-6E, 7, and 8A-8N, with FIGS. 6A-6E illustrating the slipcover being applied to the sofa 10 depicted in FIGS. 1 and 2, FIG. 7 illustrating pattern components of the slipcover 60 of FIGS. 6A-6E, and FIGS. 8A-8S illustrating a sewing sequence for assembling the pattern components of FIG. 7 to manufacture the slipcover 60 of FIGS. 6A-6E.

The slipcover 60 of the second embodiment is different from the slipcover 30 of the first embodiment in that its design is geared toward furniture having box-shaped rather than T-shaped cushion(s).

FIGS. 6A-6E illustrate the slipcover 60 being applied to the sofa 10 illustrated in FIGS. 1 and 2. Although much of the application between the first and second embodiments is the same, a full description of the application of the slipcover 60 according to the second embodiment is nevertheless provided because the reference numerals are different.

As shown in FIG. 6A, the cushion 18 is removed from the sofa 10. As shown in FIG. 6B, the slipcover 60 is applied over the top of the sofa 10, and then an elastic band 61 is placed at the base of the sofa 10. Then, as shown in FIG. 6C, the back seams 62 of the slipcover 60 are lined up with the back corners of the sofa 10. Finally, the seat cushion 18 is covered with a separate cushion cover 63 (see FIG. 6D), and the covered seat cushion 18 is placed on the slip-covered sofa 10 (see FIG. 6E).

Figure 8A:
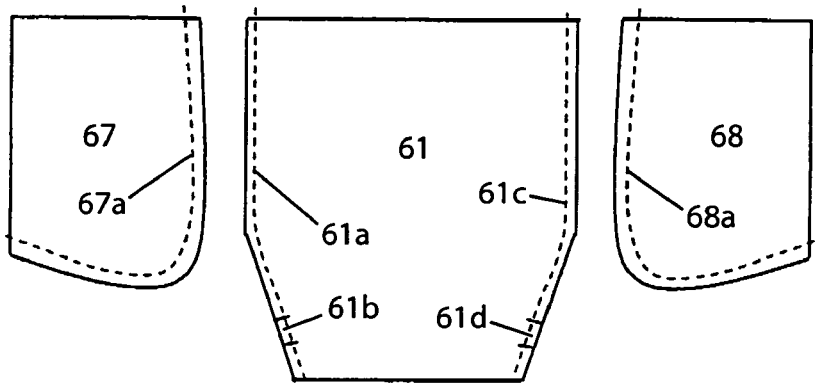
FIGS. 8A-8N are plan views illustrating a sewing sequence for assembling the pattern components of FIG. 7 to manufacture the slipcover of FIGS. 6A-6E.

FIG. 7 is a plan view of the pattern components of the slipcover 60 of the second embodiment of the present invention. FIGS. 8A-8S are plan views illustrating a sewing sequence for assembling the pattern components of FIG. 7 to manufacture the slipcover of FIGS. 6A-6E.

Referring to FIG. 7, the pattern components include a back 61, seat 62, front band 63, two side bands 64, 65, a back band 66, two arm sides 67, 68, two arm fronts 69, 70, two side seats 71, 72, two zipper bands 73, 74, and a seat cushion 77. More specifically, the back 61 is similar to an upside-down gumdrop in shape with straight side edges and a flat, lower portion. The front band 63, two side bands 64, 65, back band 66, seat 62, side seats 71, 72, and seat cushion 77 are each essentially rectangular in shape. Each of the two arm sides 67, 68 is essentially rectangular in shape on two sides and bowed in shape on the opposing two sides. The two arm fronts 69, 70 are gumdrop shaped. It is understood that while specific shapes of the pattern components have been described, it is understood that modifications to the shapes and/or sizes of these pattern components may be made provided the components are still suitable for their intended purpose.

The process for assembling the pattern components of FIG. 7 to manufacture the slipcover 60 of the second embodiment will now be described with reference to FIGS. 8A-8S.

Referring to FIG. 8A, the arm sides 67, 68 are sewn to the back 61. One side of the arm sides 67 is sewn to one side of the back 61 along seams 61*a*, 67*a* and pleated back at notch 61*b*. Similarly, one side of the other arm side 68 is sewn to the other side of the back 61 along seams 61*c*, 68*a* and pleated back at notch 61*d*.

Figure 8B:
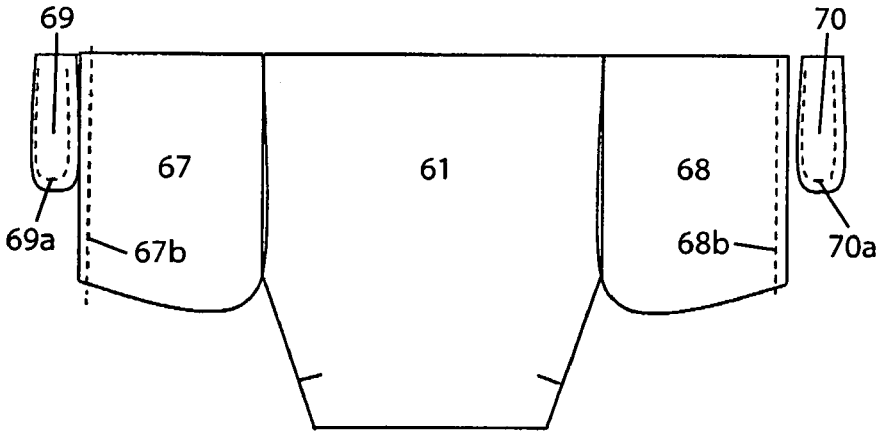

As shown in FIG. 8B, the arm fronts 69, 70 are sewn to the respective arm sides 67, 68. More specifically, the arm front 69 is sewn to the arm side 67 along seams 69*a*, 67*b* such that the flat portions of the arm front 69 and the back 61 are colinear. Similarly, but in the mirror image, the arm front 70 is sewn to the arm side 68 along seams 70*a*, 68*b* such that the flat portions of the arm front 68 and the back 61 are colinear.

Figure 8C:
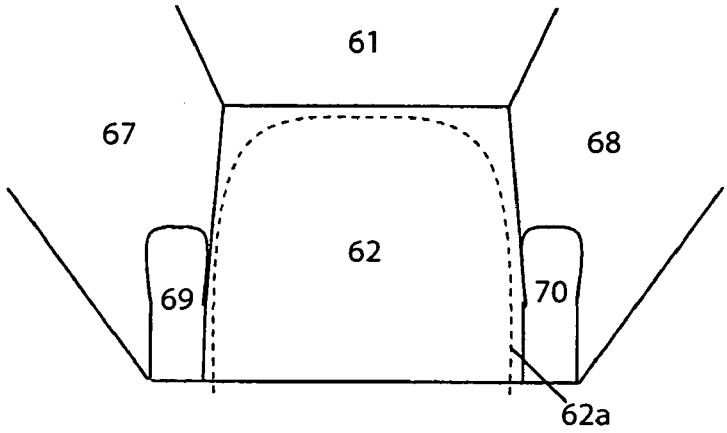

In FIG. 8C, the seat 62 is joined to the arm sides 69, 70, arm fronts 67, 68, and the back 61 along seam 62*a*.

Figure 8D:
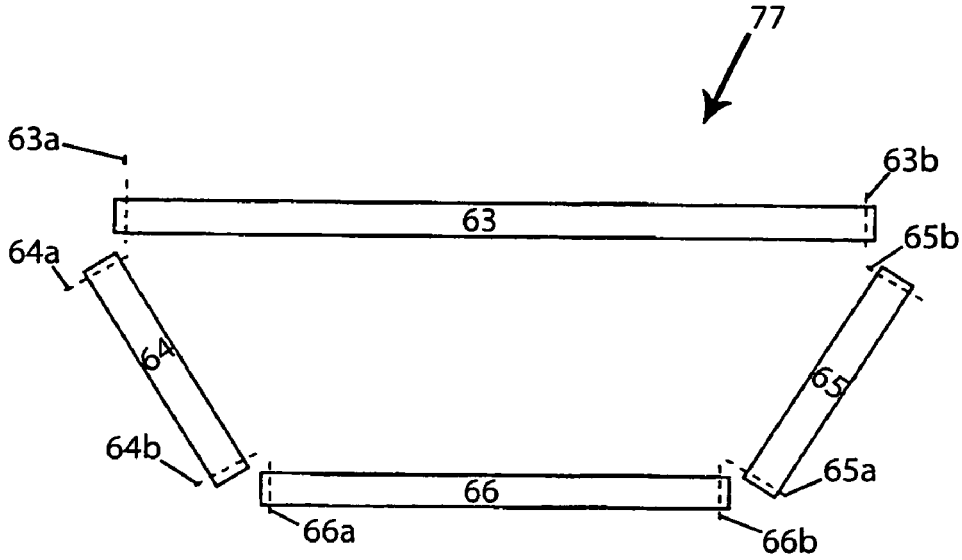

As shown in FIG. 8D, the back band 66, side bands 64, 65, and front band 63 are sewn together to form a complete band 77. More specifically, the front band 63 and the side band 64 are sewn along seams 63*a*, 64*a*, the side band 64 and the back band 66 are sewn along seams 64*b*, 66*a*, the back band 66 and the side band 65 are sewn along seams 66*b*, 65*a*, and the side band 65 and the front band 63 are sewn along seams 65*b*, 63*b*.

Figure 8E:
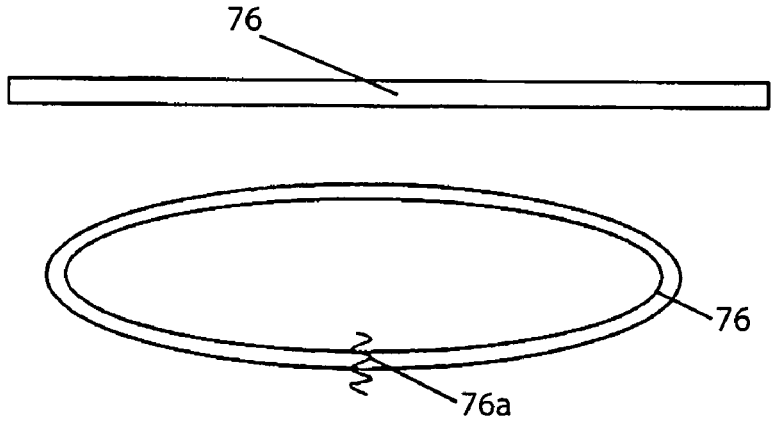
Figure 8F:
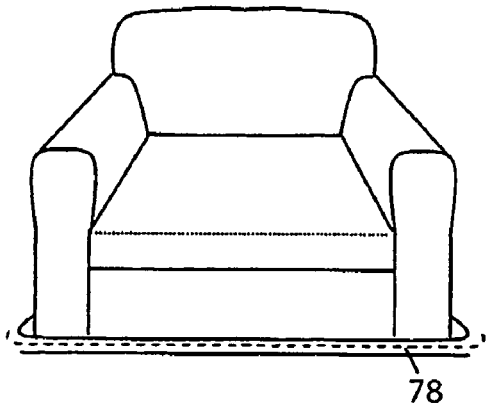
Figure 8G:
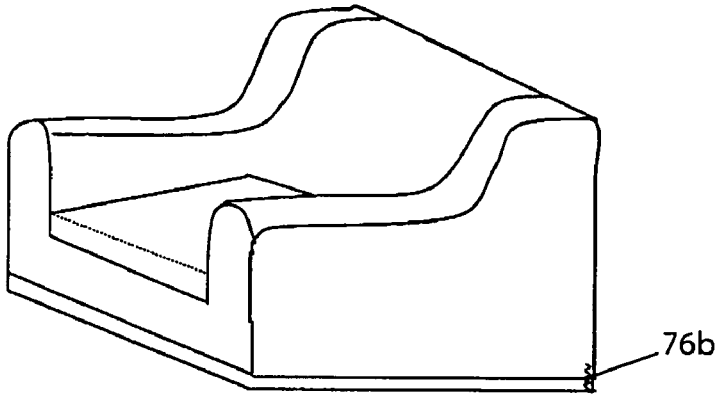

As shown in FIG. 8E, elastic 76 is cut to be half of the length of the complete band 77. Then the ends of the elastic 76 are overlapped and bar-tacked at 76*a*. As shown in FIG. 8F, the elastic 76 is placed along the inner side of the band 77 and the combined elastic/band 78 is sewn to the bottom perimeter of the slipcover. As shown in FIG. 8G, the combined elastic/band 78 is then bar-tacked at 76*b* at the back side seam.

Figure 8H:
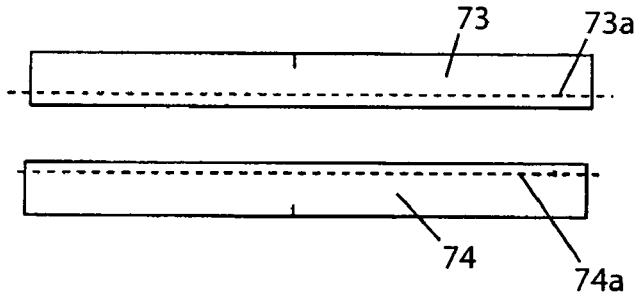
Figure 8I:
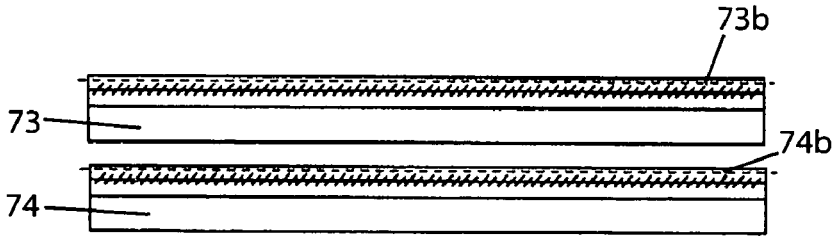
Figure 8J:
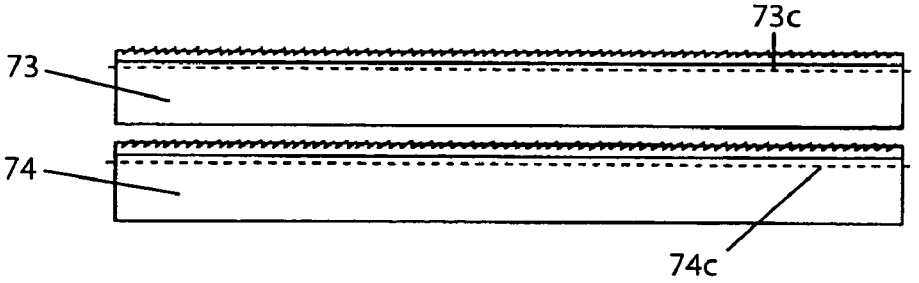
Figure 8K:
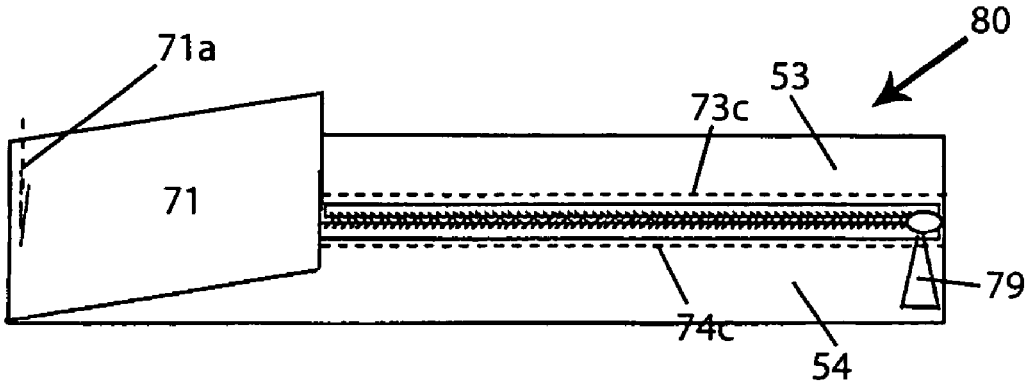
Figure 8L:
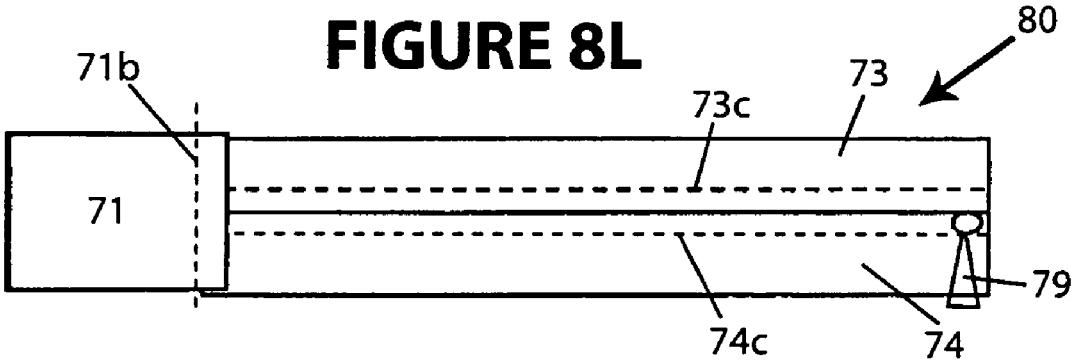
Figure 8M:
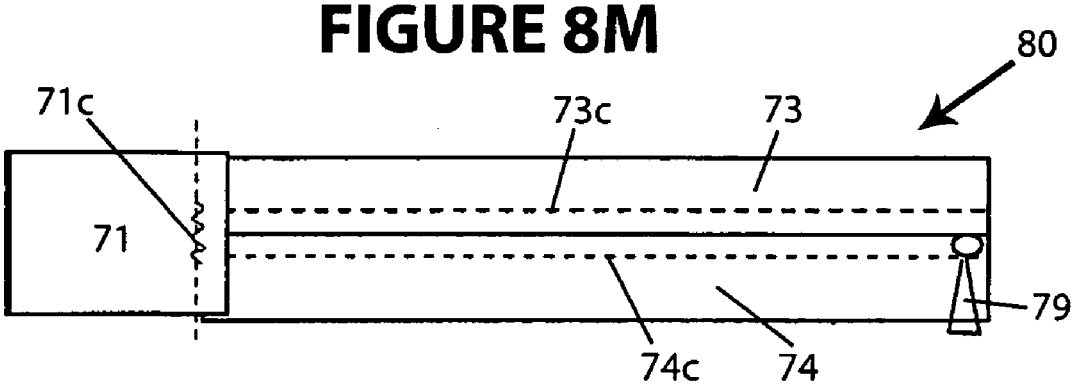

FIG. 8H shows that each of the separate zipper bands 73, 74 is edged. That is, separate zipper band 73 is edged at 73*a*, and separate zipper band 74 is edged at 74*a*. As shown in FIG. 81, respective zipper halves 73*b*, 74*b* are then sewn to respective separate zipper bands 73, 74, and then as shown in FIG. 8J, each of the zipper halves 73*b*, 74*b* is top-stitched along lines 73*c*, 74*c*, respectively. FIG. 8K shows the zipper halves 73, 74 joined together with the addition of a zipper pull 79, this combination herein after referred to as the zipper 80. Also, the seat band 71 is sewn to the zipper 80 along seam 71*a*. As shown in FIG. 8L, the seat band 71 is then flipped over toward the left to be flat with the zipper 80, and then a ¼" topstitch seam 71*b* is added. Finally, as shown in FIG. 8M, the seat band 71 is bar-tacked to the zipper 80 to reinforce this stress area. Similarly, the opposite end of the separate seat band 72 is sewn to the opposite end of the zipper band 74, topstitched, and bar-tacked.

Figure 8N:
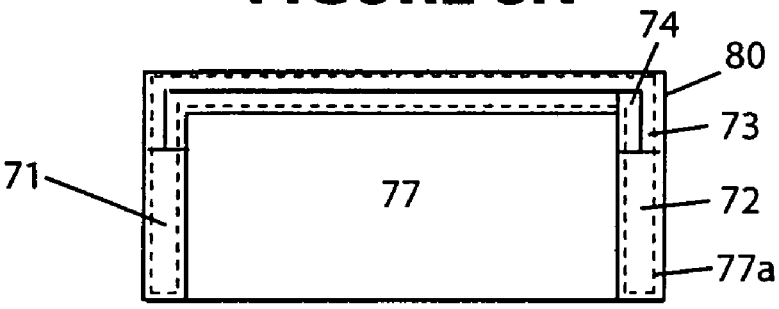

As shown in FIG. 8N, the seat cushion cover is assembled. That is, the zipper 80 and the two side seats 71, 72 are sewn around half of the seat cushion 77 (shown) and the other half of the seat cushion 77 (not shown).

As discussed above, a significant feature of the slipcover of the present invention according to the second embodiment is the ability of the slipcover to accommodate various dimensional ranges of furniture with box-shaped cushions. In this second embodiment this feature is accomplished through the specific stretch properties of the slipcover fabric and the design of the pattern. The slipcover therefore accommodates varies dimensional ranges of box-shaped cushion furniture, yet still provides a good fit.

The slipcover has been described as being applicable to a sofa, it is understood that the slipcover may be applied to any seating-type furniture having a base, a back, and generally a seat cushion, though a seat cushion is not a requirement. The slipcover patterns may been designed for chair widths of, for example, 32"-43", love seat widths of, for example, 58"-73", and sofa widths of, for example, 74"-96".

Thus, while there have been shown, described and pointed out fundamental novel features of the invention as applied to a preferred embodiments thereof, it is understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A slipcover for a piece of furniture comprising:

a base;

a back; and a seat portion, wherein the slipcover includes at least one fabric panel for each of the base, the back and the seat portion, the at least one base panel, the at least one back panel and the at least one seat panel being assembled to form the slipcover, and wherein each of the at least one base panel, the at least one back panel and the at least one seat panel exhibits a stretch in length which behaves dynamically with respect to a stretch in width, with the minimum stretch in fabric width being at least 60% while the minimum stretch in fabric length is at least 40%.

2. The slipcover of claim 1, wherein the slipcover is form-fit to the furniture when the stretch in fabric width of 60% is reduced by approximately 10% or more.

3. The slipcover of claim 1, wherein when the slipcover is form-fit to the furniture and the stretch in fabric width of 60% is reduced by 10%, the stretch in fabric length of 40% is reduced by 25%.

4. The slipcover of claim 3, wherein each fabric panel of the base, the back and the seat portion remains stretched in both width and length directions after the slipcover is form-fit to the furniture.

5. The slipcover of claim 1, wherein the slipcover fabric comprises a minimum of 5% spandex.

6. The slipcover of claim 1, wherein the slipcover fabric comprises a minimum of 5% elastic fiber.

7. The slipcover of claim 1, wherein the furniture has a T shaped-cushion, and the slipcover is specifically patterned to fit T-cushion furniture with at least one separate seat cushion.

8. The slipcover of claim 7, wherein the slipcover further comprises a T-cushion cover having at least one T-cushion panel, the at least one T-cushion panel having a stretch in length which behaves dynamically with respect to a stretch in width, with the minimum stretch in fabric width being at least 60% while the minimum stretch in fabric length is at least 40%.

9. The slipcover of claim 1, wherein the furniture has a box shaped-cushion, and the slipcover is specifically patterned to fit box-cushion furniture with at least one separate seat cushion.

10. The slipcover of claim 9, wherein the slipcover further comprises a box-cushion cover having at least one box-cushion panel, the at least one box-cushion panel having a stretch in length which behaves dynamically with respect to a stretch in width, with the minimum stretch in fabric width being at least 60% while the minimum stretch in fabric length is at least 40%.

11. The slipcover of claim 1, wherein the furniture has at least one arm, and the slipcover is specifically patterned to fit the at least one arm, the slipcover further comprising:

at least one arm panel, the at least one arm panel being assembled with the at least one base panel, the at least one back panel and the at least one seat panel to form the slipcover, wherein:

the at least one arm panel has a stretch in length which behaves dynamically with respect to a stretch in width, with the minimum stretch in fabric width being 60%, the minimum stretch in fabric length being 40%.

12. A slipcover for a piece of furniture comprising:

a base portion including a seat platform panel;

two arm portions each including an arm side panel and an arm front panel a back panel having a rear edge, a front edge and two side edges; and a seat cushion cover including a plurality of seat cover panels together defining a top, a bottom and a plurality of sides of the seat cushion cover, wherein:

each arm side panel is secured to one of the side edges of the back panel, a portion of each side edge of the back panel having a pleat positioned in proximity to the front edge of the back panel;

each arm front panel is secured to an arm side panel;

a rear edge of the seat platform is secured to the front edge of the back panel, and side edges of the seat platform are secured to the arm side panels and to the arm front panels; and each of seat platform panel, the arm side panels, the arm front panels, the back panel and the plurality of seat cushion panels has a stretch in length which behaves dynamically with respect to a stretch in width, with the minimum stretch in fabric width being at least 60% while the minimum stretch in fabric length is at least 40%.

13. The slipcover of claim 12, further comprising an elastic band secured to portions at least of the seat platform panel, arm side panels and back panel at a bottom perimeter of the slipcover.

14. The slipcover of claim 12, wherein the seat cushion cover is patterned to fit box-cushion furniture with at least one separate seat cushion.

15. The slipcover of claim 12, wherein the seat cushion cover is patterned to fit T-cushion furniture with at least one separate seat cushion.

16. The slipcover of claim 12, wherein the plurality of seat cushion panels includes a top panel, a bottom panel, a side band panel and two sipper band panels, wherein a zipper and the side band panel are secured to the zipper band panels for forming side surfaces of the seat cushion cover.

17. The slipcover of claim 12, wherein the plurality of seat cushion panels includes a panel for covering top, bottom and front sides of the seat cushion, two side panels and two zipper band panels, wherein a zipper is secured to the zipper band panels and each of two ends of the sipper band panels is secured to one of the two side panels to form left, right and rear side surfaces of the seat cushion cover.

18. A method for assembling a slipcover for a piece of furniture, the method comprising the steps of:

preparing a seat platform panel, two arm side panels, two arm front panels, a back panel and a plurality of seat cushion panels from a material that has a stretch in length which behaves dynamically with respect to a stretch in width, with the minimum stretch in fabric width being 60%, the minimum stretch in fabric length being 40%;

providing a pleat at a portion of each of two side edges of the back panel, each pleat being positioned in proximity to a front edge of the back panel;

securing each arm side panel to one of the two side edges of the back panel;

securing each arm front panel to one of the two arm side panels;

securing a rear edge of the seat platform to the front edge of the back panel, and securing side edges of the seat platform are to the arm side panels and to the arm front panels.

19. The method of claim 18, wherein the plurality of seat cushion panels includes a top panel, a bottom panel, a side band panel and two sipper band panels, further comprising the steps of:

securing a sipper to the zipper band panels;

securing the side band panel to the zipper band panels for forming a side surface panel of the seat cushion cover; and securing the side surface panel to each of the top panel and the bottom panel.

20. The method of claim 18, wherein the plurality of seat cushion panels includes a panel for covering top, bottom and front sides of the seat cushion, two side panels and two zipper band panels, further comprising the steps of:

secured a zipper to the zipper band panels securing each of two ends of the zipper band panels to one of the two side panels to form left, right and rear side panel of the seat cushion cover; and securing the left, right and rear side panel to the panel for covering the top, bottom and front sides of the seat cushion.

21. The method of claim 18, wherein the securing steps are performed by sewing the panels to be secured together along a seam positioned at adjacent edges of the panels to be secured.

* * * * *